US009470495B2

(12) United States Patent
Kravel

(10) Patent No.: US 9,470,495 B2
(45) Date of Patent: Oct. 18, 2016

(54) RUBBER FRAGMENTATION GRENADE

(71) Applicant: Combined Systems, Inc., Jamestown, PA (US)

(72) Inventor: Jacob Kravel, Great Neck, NY (US)

(73) Assignee: COMBINED SYSTEMS, INC., Jamestown, PA (US)

( * ) Notice: Subject to any disclaimer, the term of this patent is extended or adjusted under 35 U.S.C. 154(b) by 0 days.

(21) Appl. No.: 14/664,647

(22) Filed: Mar. 20, 2015

(65) Prior Publication Data

US 2016/0273898 A1 Sep. 22, 2016

(51) Int. Cl.

| | |
|---|---|
| ***F42B 27/00*** | (2006.01) |
| ***F42B 27/08*** | (2006.01) |
| ***F42B 12/24*** | (2006.01) |

(52) U.S. Cl.

CPC ..... *F42B 27/08* (2013.01); *F42B 12/24* (2013.01); *F42B 27/00* (2013.01)

(58) Field of Classification Search

CPC ..... F42B 27/08; F42B 12/24; F42B 27/00
USPC ..... 102/482
See application file for complete search history.

(56) References Cited

U.S. PATENT DOCUMENTS

| | | | | |
|---|---|---|---|---|
| 4,817,532 | A * | 4/1989 | Assmann | F42B 12/20 102/482 |
| 6,857,372 | B2 * | 2/2005 | Renaud-Bezot | F42B 12/22 102/493 |
| 6,962,113 | B1 | 11/2005 | Carlson et al. | |
| 8,136,437 | B2 * | 3/2012 | Van Stratum | F42B 27/08 102/368 |
| 8,286,558 | B2 * | 10/2012 | Marx | F42B 14/02 102/527 |
| 8,365,670 | B2 * | 2/2013 | Abramov | F42B 12/24 102/482 |
| 8,671,840 | B2 * | 3/2014 | Scheid | F42B 12/32 102/495 |
| 8,726,810 | B2 | 5/2014 | Kravel | |
| 2011/0232466 | A1 * | 9/2011 | Stratum | F42B 33/025 86/1.1 |
| 2012/0192753 | A1 * | 8/2012 | Scheid | F42B 12/32 102/495 |
| 2013/0125773 | A1 * | 5/2013 | Brunn | F42B 27/00 102/334 |
| 2013/0186295 | A1 | 7/2013 | Kravel | |
| 2014/0013986 | A1 * | 1/2014 | Mendes | F42B 12/387 102/487 |

* cited by examiner

*Primary Examiner* — Michelle R Clement
(74) *Attorney, Agent, or Firm* — Bennet K. Langlotz; Langlotz Patent & Trademark Works, Inc.

(57) ABSTRACT

A rubber fragmentation grenade has a body containing an explosive charge, a fuse assembly connected to the body, an elastomeric outer layer at least partly encompassing the body, and the outer layer being scored to provide a plurality of segments. The segments may be rectangular. Each segment may have a thickness, and may have a width greater than the thickness. The thickness may be at least one-third of the width. The body may include a cylindrical portion, and the outer layer may be a cylindrical sleeve encompassing the cylindrical portion. The segments may include a ring of segments. Each ring may include six segments. The explosive charge may be an elongated shape defining a charge axis and having opposed ends, the elastomeric outer layer being a cylindrical form being concentric with the charge. The elastomeric outer layer may extend beyond the ends of the charge.

20 Claims, 4 Drawing Sheets

RUBBER FRAGMENTATION GRENADE

FIELD OF THE INVENTION

The present invention relates to grenades, and more particularly to non-lethal grenades for crowd control.

BACKGROUND OF THE INVENTION

Conventional stingball grenades use a design derived from fragmentation grenades. However, instead of using a metal casing to produce potentially lethal shrapnel, they are made from two spheres of hard rubber. The smaller, inner sphere houses the explosive charge, primer, and detonator, and the outer sphere is the grenade casing. Upon detonation, the rubber balls explode outward in all directions, each one capable of inflicting a non-lethal but painful, stinging impact. Some types have an additional payload of chemical agents. The space between the two spheres can be filled with CS, CN, or OC powder or liquid, all of which are lachrymatory agents (tear gas).

A significant disadvantage of conventional stingball grenade designs is that they produce highly variable quantities and sizes of shrapnel. The pellets are sufficiently small that they can cause considerable damage to eyes and other soft tissue. The rubber spheres can also produce significant quantities of small shrapnel. To limit the potential for injuries, some law enforcement agencies limit shrapnel size to no smaller than 16 mm×16 mm.

Therefore, a need exists for a new and improved grenade that fragments into consistent quantities and sizes of shrapnel. In this regard, the various embodiments of the present invention substantially fulfill at least some of these needs. In this respect, the rubber fragmentation grenade according to the present invention substantially departs from the conventional concepts and designs of the prior art, and in doing so provides an apparatus primarily developed for the purpose of providing a grenade that fragments into consistent quantities and sizes of shrapnel.

SUMMARY OF THE INVENTION

The present invention provides an improved rubber fragmentation grenade, and overcomes the above-mentioned disadvantages and drawbacks of the prior art. As such, the general purpose of the present invention, which will be described subsequently in greater detail, is to provide an improved rubber fragmentation grenade that has all the advantages of the prior art mentioned above.

To attain this, the preferred embodiment of the present invention essentially comprises a body containing an explosive charge, a fuse assembly connected to the body, an elastomeric outer layer at least partly encompassing the body, and the outer layer being scored to provide a plurality of segments. The segments may be rectangular. Each segment may have a thickness, and may have a width greater than the thickness. The thickness may be at least one-third of the width. The body may include a cylindrical portion, and the outer layer may be a cylindrical sleeve encompassing the cylindrical portion. The segments may include a ring of segments. Each ring may include six segments. The explosive charge may be an elongated shape defining a charge axis and having opposed ends, the elastomeric outer layer being a cylindrical form being concentric with the charge. The elastomeric outer layer may extend beyond the ends of the charge.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
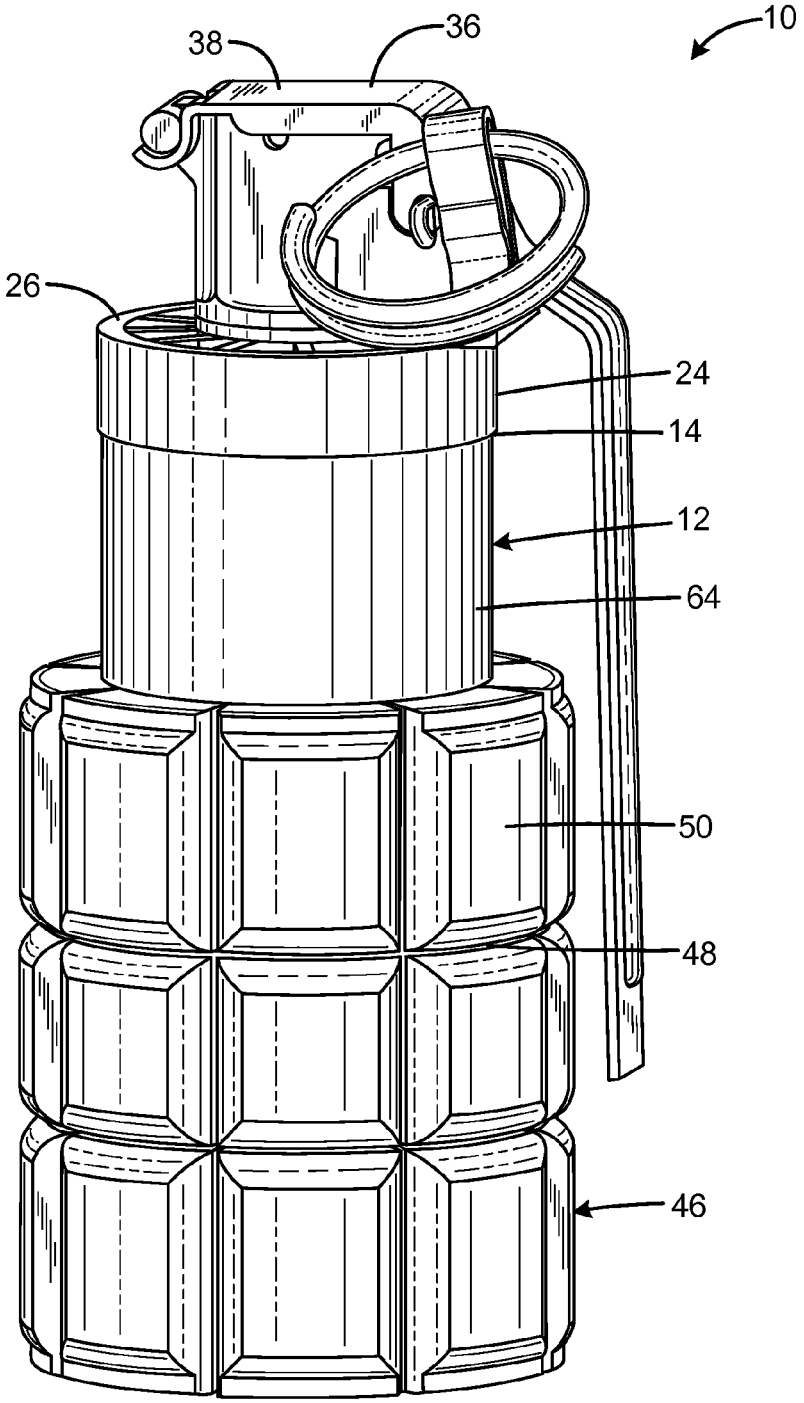
FIG. 1 is a side view of the current embodiment of a rubber fragmentation grenade constructed in accordance with the principles of the present invention.

An embodiment of the rubber fragmentation grenade of the present invention is shown and generally designated by the reference numeral 10.

FIG. 1 illustrates the improved rubber fragmentation grenade 10 of the present invention in an assembled state. More particularly, the rubber fragmentation grenade has a cylindrical body 12 having a top 14 and an exterior surface 64. A housing 46 surrounds the lower portion of the exterior of the body. The housing includes a plurality of rubber segments 50 defined by scores 48. A top cap 24 encloses the top of the body. The top 38 of a fuse 36 is attached to the top cap. In the current embodiment, the housing is made of rubber having a hardness of 60-90 Durometer "A" Scale, and the body and top cap are made of plastic. In the current embodiment, the fuse 36 is the fuse disclosed in U.S. Pat. No. 8,726,810, which is hereby incorporated by reference in its entirety. The rubber segments are rectangular and have a width greater than their thickness. In the current embodiment, the thickness is at least one-third of the width.

Figure 2:
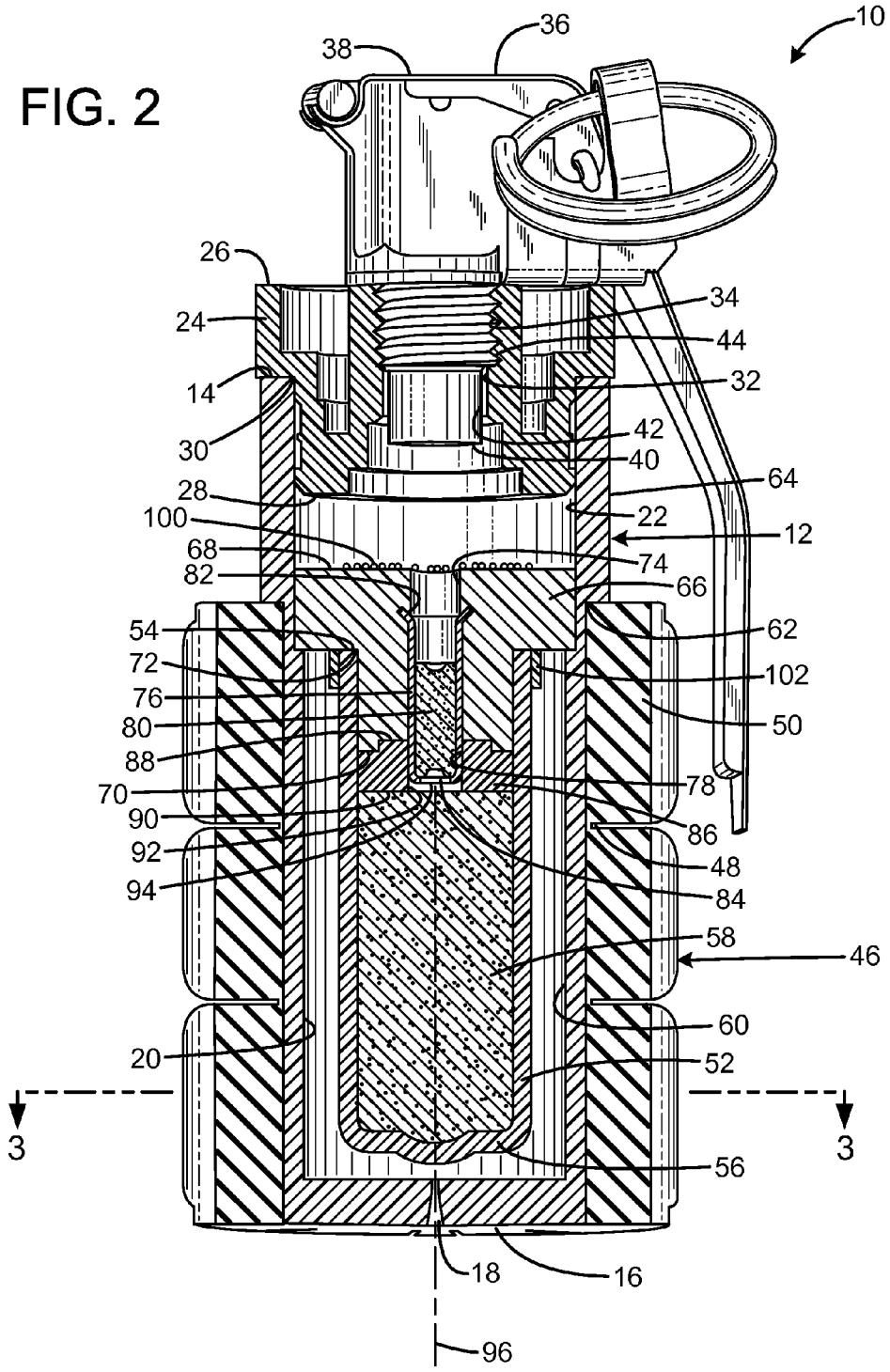
FIG. 2 is a side sectional view of the current embodiment of the rubber fragmentation grenade of FIG. 1.
Figure 3:
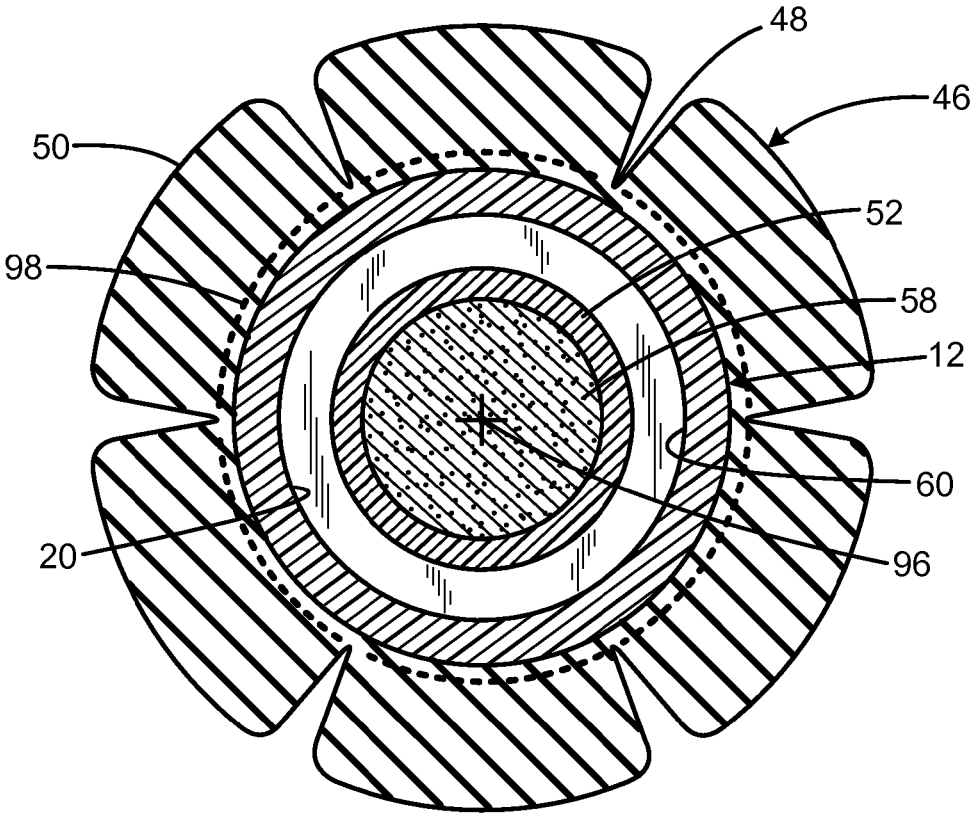
FIG. 3 is a bottom sectional view of the current embodiment of the rubber fragmentation grenade of FIG. 1.

FIGS. 2 and 3 illustrate the improved rubber fragmentation grenade 10 of the present invention in a filled state. More particularly, the rubber fragmentation grenade has a cylindrical body 12 having a top 14, a bottom 16, an exterior 64, a central bore 22 that defines an interior wall 20. The exterior defines a shoulder 62 where the housing 46 terminates. The bottom defines a score 18.

The top cap 24 has a top 26, a bottom 28, and a shoulder 30. The top cap is attached to the top 14 of the body 12 by frictional engagement of the bottom of the top cap with the interior wall 20 of the body. In the current embodiment, the shoulder protrudes outward by an amount equal to the thickness of the body to provide a flush fit between the top cap and the body.

The top 26 of the top cap 24 defines a central bore 32 in communication with the central bore 22 of the body 12. The central bore 32 has a threaded portion 34.

The fuse 36 has a top 38, a bottom 40, and a central bore 42. The bottom exterior of the fuse has a threaded portion 44. The fuse is threadedly attached to the top 26 of the top cap 24 by engagement of the threaded portion 44 with the threaded portion 34 in the central bore 32 of the top cap. In the current embodiment, the fuse has a 1.5 second delay.

When the rubber fragmentation grenade 10 is in a filled state, the central bore 60 of the body 12 receives a charge housing 52. The charge housing has an open top 54 and a closed bottom 56, and is an elongated shape defining a charge axis 96. The housing 46 is a cylindrical form that is concentric with the charge housing and extends beyond the top and bottom of the charge housing. The bottom of the charge housing is filled with a pyrotechnic charge 58 consisting of aluminum powder, potassium perchlorate, and magnesium powder. The top of the charge housing is closed by a secondary delay charge top cap 66 and a secondary delay charge bottom cap 86. The secondary delay charge top cap has a top 68, a bottom 70, and a central bore 74. The secondary delay charge bottom cap has a top 88, a bottom 90, and a central bore 92. The top of the secondary delay charge bottom cap abuts the bottom of the secondary delay charge top cap, and their central bores 74, 92 are axially registered. A fuse ejection charge 100 in the form of grains of black powder in the current embodiment is positioned on the top of the secondary delay charge top cap over central bore 74. A slip ring 102 is positioned on the exterior of the open top of the charge housing to exert pressure against the secondary delay charge top cap when the secondary delay charge top cap is inserted into the open top of the charge housing.

A secondary delay charge housing 76 is received with the central bores 74, 92 of the top and bottom secondary delay charge caps 66, 86. The secondary delay charge housing has a flared open mouth 82 and a bottom 94 with an aperture 84. The bottom is filled with a secondary delay charge 80 consisting of black powder. In the current embodiment, the secondary delay charge housing is made of rubber, and the secondary delay charge burns for 1 second.

When the fuse 36 is triggered, a spark travels down the central bore 42 after a 1.5 second delay in the current embodiment and passes through the central bore 32 of the top cap 24, where the spark ignites the fuse ejection charge 100. The gases generated by the burning fuse ejection charge eject the fuse 36 from the top cap 24. The fuse ejection is essential so the fuse will not become a potentially dangerous projectile when the charge 58 ignites and the grenade 10 explodes. The spark continues through the central bore 74 of the secondary delay charge top cap 66. The spark passes through the open mouth 82 of the secondary delay charge housing 76 and ignites the secondary delay charge 80. The secondary delay charge burns for 1 second in the current embodiment.

As is shown in FIG. 3, the housing 46 is a cylindrical sleeve encompassing the cylindrical body 12. The rubber segments 50 form three rings of segments. Each ring includes six segments in the current embodiment, which ensures the segments are at least 16 mm×16 mm when the grenade 10 explodes. The scores 48 between the rubber segments create a connection web 98 proximate to the body that has a thickness less than the thickness of the rubber segments. In the current embodiment, the connection web has a thickness that is less than half of the rubber segment thickness. Each rubber segment has a periphery adjacent to the connection web, and the peripheries of adjacent segments abut each other, such that there is minimal space between the segments.

Figure 4:
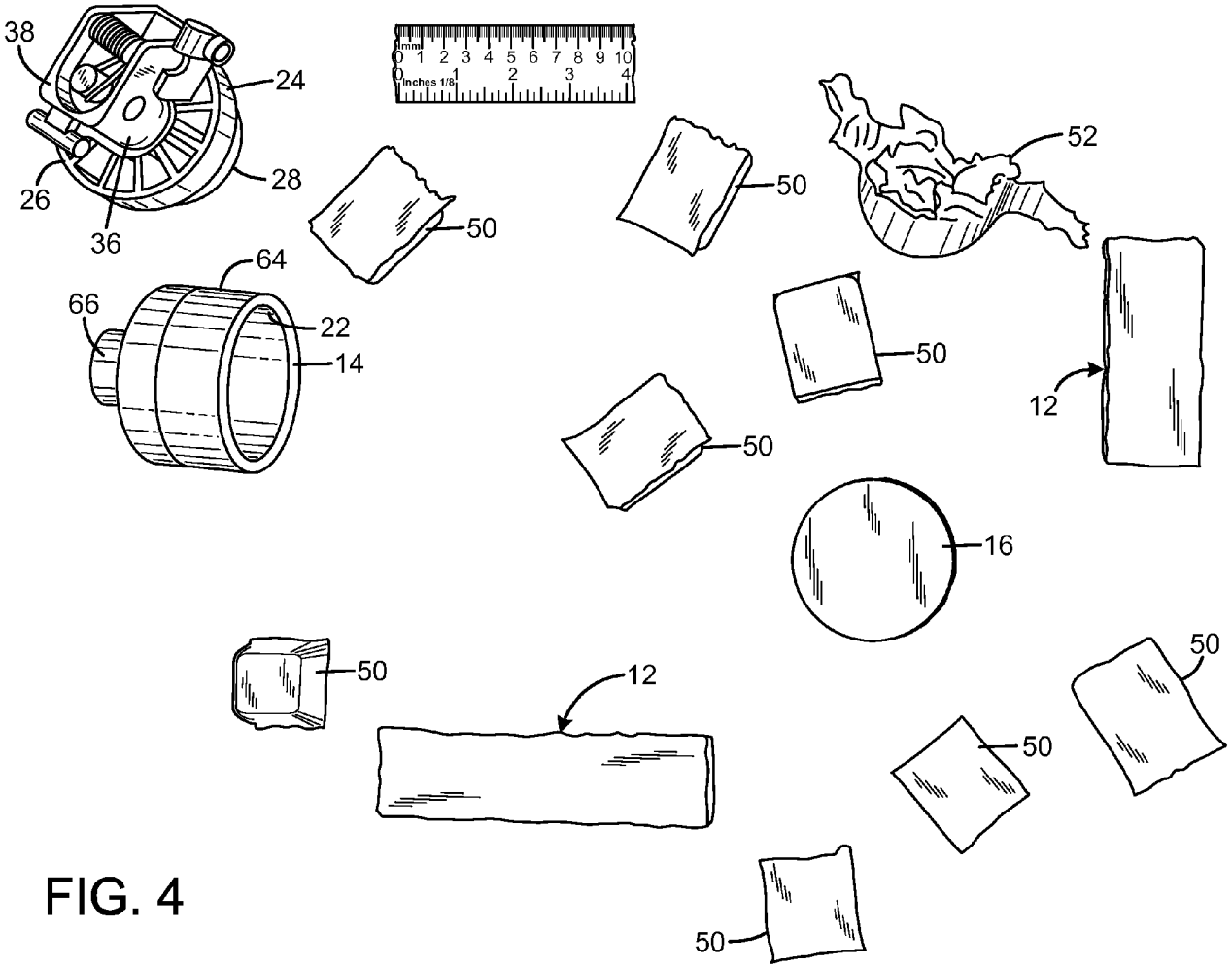
FIG. 4 is a top view of the current embodiment of the rubber fragmentation grenade of FIG. 1 after discharge.

FIG. 4 illustrates the improved rubber fragmentation grenade 10 of the present invention in the after discharge state. More particularly, the burning secondary delay charge 80 subsequently emits a spark through aperture 84 in the bottom 94 of the secondary delay charge housing 76 that ignites the charge 58. The resulting gases cause the body 12 and the housing 56 to fragment along the scores 18, 48. The resulting segments 50 and body fragments are emitted into the external environment. The grenade also emits a loud explosion sound at a volume of 175 dB. A representative illustration of a discharged rubber fragmentation grenade 10 is shown in in FIG. 3. The smaller middle segments weigh 4.3 g in the current embodiment, the larger top and bottom segments weigh 5.9 g in the current embodiment, and the smallest piece of shrapnel is at least 16 mm×16 mm. The segments can also be fabricated so they are all of a uniform weight and size.

In the current embodiment, the rubber fragmentation grenade 10 is adapted to be hand thrown. However, the rubber fragmentation grenade 10 can be altered to be launched by any desired firearm.

While a current embodiment of a rubber fragmentation grenade has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exploding device comprising:

a body containing an explosive charge;

a fuse assembly connected to the body;

an elastomeric outer layer at least partly encompassing the body; and the outer layer scored to a depth less than a thickness of the outer layer to provide a plurality of interconnected segments.

2. The device of claim 1 wherein the segments are rectangular.

3. The device of claim 1 wherein each segment has a thickness, and has a width greater than the thickness.

4. The device of claim 3 wherein the thickness is at least one-third of the width.

5. The device of claim 1 wherein the body includes a cylindrical portion, and the outer layer is a cylindrical sleeve formed of the same material as the segments and encompassing the cylindrical portion.

6. The device of claim 1 wherein the segments include a ring of segments.

7. The device of claim 6 wherein each ring includes six segments.

8. The device of claim 6 wherein each ring includes at least four segments.

9. The device of claim 1 wherein the explosive charge is an elongated shape defining a charge axis and having opposed ends, the elastomeric outer layer being a cylindrical form being concentric with the charge.

10. The device of claim 9 wherein the elastomeric outer layer extends beyond the ends of the charge.

11. The device of claim 1 wherein the segments each have a thickness, and are connected to adjacent segments by a connection web formed of the same material as the segments and proximate to the body, and wherein the web has a thickness less than the segment thickness.

12. The device of claim 1 wherein the web has a thickness less than half of the segment thickness.

13. The device of claim 1 wherein each segment has a periphery adjacent to the web, and wherein the peripheries of adjacent segments abut each other, such that there is minimal space between the segments.

14. A grenade comprising:

a body defining a body axis and having a sidewall and a hollow interior;

the body interior containing an ignition component;

a housing encompassing a portion of the sidewall of the body;

the housing scored to a depth less than a thickness of the housing;

the scores dividing the housing into a plurality of interconnected segments; and responsive to ignition of the ignition component, the housing separating along the scores into a plurality of segment projectiles.

15. The grenade of claim 14 further comprising:

a fuse attached to the body;

a pyrotechnic charge within the hollow interior of the body;

responsive to ignition of the pyrotechnic charge, the fuse separating from the body.

16. The grenade of claim 15 wherein the pyrotechnic charge is ignited before the ignition component is ignited.

17. The grenade of claim 14 wherein the housing is made of rubber.

18. The grenade of claim 17 wherein the housing has a hardness of at least 60 and less than or equal to 90 Durometer "A" Scale.

19. The grenade of claim 14 wherein the segment projectiles have a weight of at least 4.3 g and a weight less than or equal to 5.9 g.

20. The grenade of claim 14 wherein the segment projectiles are at least 16 mm long and 16 mm wide.

* * * * *